United States Patent [19]

Mobius

[11] 4,281,698

[45] Aug. 4, 1981

[54] PENCIL SHARPENER

[76] Inventor: Werner Mobius, Hindenburgstrasse 77, 8520 Erlangen, Fed. Rep. of Germany

[21] Appl. No.: 30,653

[22] Filed: Apr. 16, 1979

[30] Foreign Application Priority Data

Apr. 22, 1978 [DE] Fed. Rep. of Germany ... 7812337[U]

[51] Int. Cl.[3] ..... B43L 23/00

[52] U.S. Cl. ..... 145/3.31; 145/3.61

[58] Field of Search ..... 145/3.31, 3.3, 3.5, 145/3.6, 3.61

[56] References Cited

U.S. PATENT DOCUMENTS

| | | | |
|---|---|---|---|
| 161,126 | 3/1875 | Keyes | 145/3.3 |
| 496,128 | 4/1893 | Moore | 145/3.31 |
| 653,720 | 7/1900 | Weitzel | 145/3.31 |
| 703,967 | 7/1902 | O'Byrne | 145/3.6 |
| 942,107 | 12/1909 | Rydquist | 145/3.31 |
| 2,122,386 | 6/1938 | Wells | 145/3.31 |
| 2,221,239 | 11/1940 | Johnston | 145/3.31 |
| 2,502,177 | 3/1950 | Sigman | 145/3.31 |
| 2,857,884 | 10/1958 | Itano | 145/3.31 |
| 3,294,067 | 12/1966 | Chipman et al. | 145/3.61 |

FOREIGN PATENT DOCUMENTS

| | | | |
|---|---|---|---|
| 133762 | 6/1933 | Austria | 145/3.31 |
| 954674 | 12/1956 | Fed. Rep. of Germany | 145/3.31 |
| 963305 | 5/1957 | Fed. Rep. of Germany | 145/3.31 |
| 16531 | 7/1913 | United Kingdom | 145/3.31 |

*Primary Examiner*—James L. Jones, Jr.
*Assistant Examiner*—J. T. Zatarga
*Attorney, Agent, or Firm*—Holman & Stern

[57] ABSTRACT

A pencil sharpener is disclosed which comprises a box-like collector housing and an integral cover and sharpener body preferably formed as an extrusion which connects onto the housing via complimentary catch members with the sharpener body projecting into the housing.

4 Claims, 3 Drawing Figures

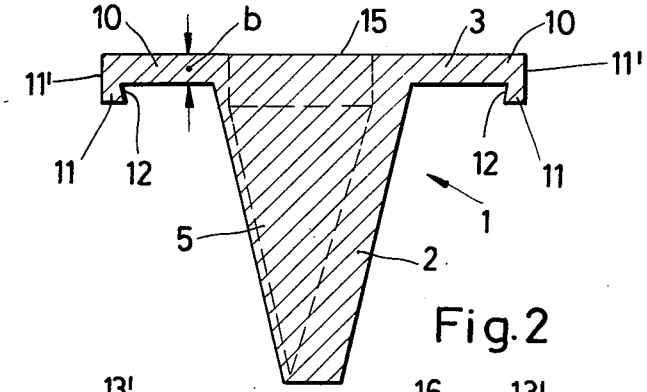
Fig.2
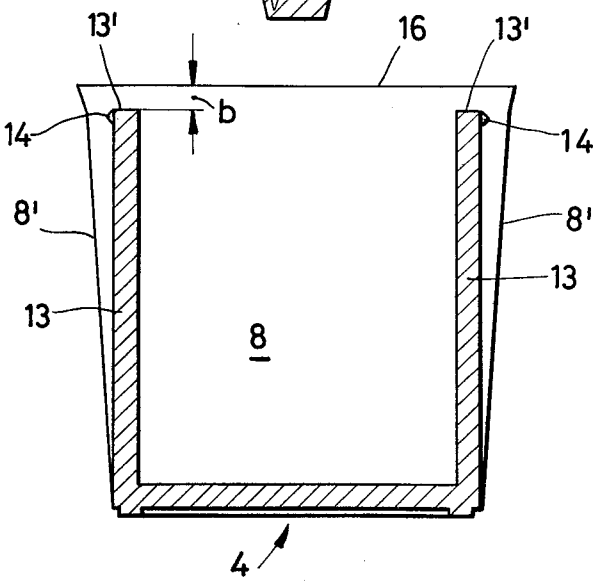
Fig.1
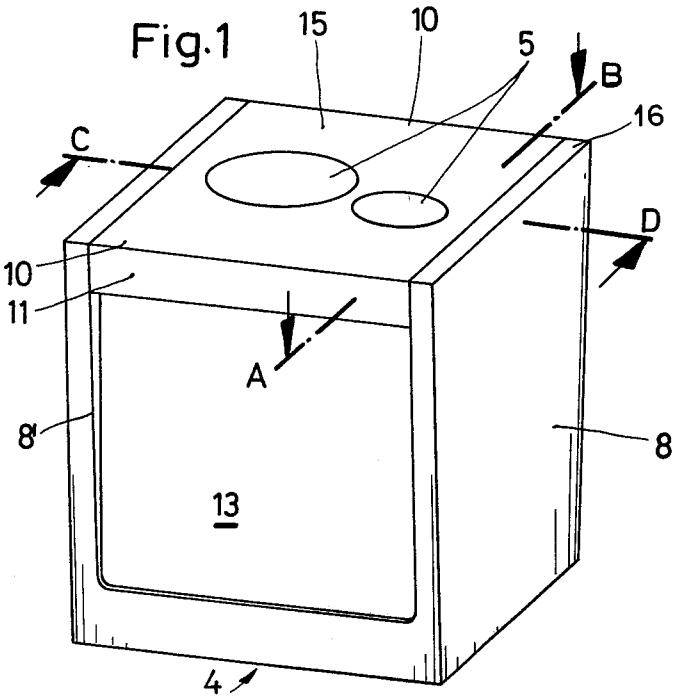

PENCIL SHARPENER

BRIEF SUMMARY OF THE INVENTION

The invention relates to a pencil sharpener with a collector housing, in which a cover, carrying the sharpener, is detachably connected to the collector housing and the sharpener projects in the said housing. An arrangement of the above mentioned generic type of the invention is disclosed in German Offenlegungsschrift No. 2,224,888. It has proved successful in practice. The object of the invention is to reduce the manufacturing costs compared to this prior art sharpener.

The invention proposes, in a pencil sharpener of the generic type mentioned initially, that the cover should be integral with the body of the sharpener. This achieves a substantial saving of manufacturing costs, since it is not necessary, as hitherto, to manufacture two separate components (the sharpener body and the cover) and join them together. Instead they are manufactured in one piece. Accordingly, all that remains is to screw the blade or the blades to the sharpener body, which was also necessary hitherto. Since pencil sharpeners are very definitely mass-produced articles, the reduction in manufacturing cost achieved by means of the invention is of substantial importance.

According to a preferred embodiment of the invention, the cover and sharpener body consist of a length cut from an extruded profile. In the process of manufacture, it is necessary to provide an extruded profile having a cross-section which corresponds to the cross-section of the unit comprising the cover and the sharpener body. It then merely remains to cut such above mentioned units from this extruded profile and provide them with the sharpener holes and sharpener blades.

According to another embodiment of the invention, the units consisting of the cover and the sharpener body can be an integrally injection-moulded component. This again entails only low manufacturing costs. Furthermore, it provides the advantage that the sharpener holes can be formed simultaneously by injection-moulding.

The units comprising the sharpener body and cover can consist of, and be moulded from, either metal or plastic.

A further embodiment of the invention provides that the unit comprising the cover and the sharpener body is delimited, on two mutually opposite sides, by two continuous outer surfaces, and that the collector housing possesses, on two mutually opposite guide walls, two continuous inner surfaces, the dimensions of the sharpener components being selected so that the outer surfaces slidingly fit into the inner surfaces. This provides a simple push-fit connection between the collector housing, on the one hand, and the cover/sharpener body unit, on the other. Futhermore, it achieves another, substantial advantage of the invention, namely that the external dimensions of the collector housing are relatively small. They correspond substantially to the external dimensions of the sharpener body, plus a space, which can be kept small, for collecting the shavings produced by the sharpener. Such a pencil sharpener is therefore particularly suitable for carrying, for example, in a schoolchild's pencilcase, or in a handbag, for sharpening cosmetic sticks.

The invention further provides that the two outer surfaces as well as the two inner surfaces are each mutually parallel. In this case, it is particularly advisable to manufacture the cover/sharpener body unit by cutting a length from an extruded profile.

A further and also advantageous embodiment of the invention provides that the cover/sharpener body unit, on the one hand, and the collector housing, on the other, can be joined to one another by a catch or snap-fit arrangement. The catches or snap-fit means, required for this purpose, can be produced at little cost during manufacture, and can, for example, be included in the cross-section of an extruded profile. The engagement and subsequent release of this catch and snap-fit can be carried out rapidly and simply, even where children's clumsy hands are concerned.

Further advantages and characteristics of the invention may be found in the sub-claims and in the description which follows, and the corresponding drawing of and illustrative embodiment according to the invention.

BRIEF DESCRIPTION OF DRAWINGS

FIG. 1 shows an illustrative embodiment of the invention, in perspective view, FIG. 2 shows a section along line A–B in FIG. 1, the cover/sharpener body unit having been taken off the collector housing.

DETAILED DESCRIPTION

Figure 3:
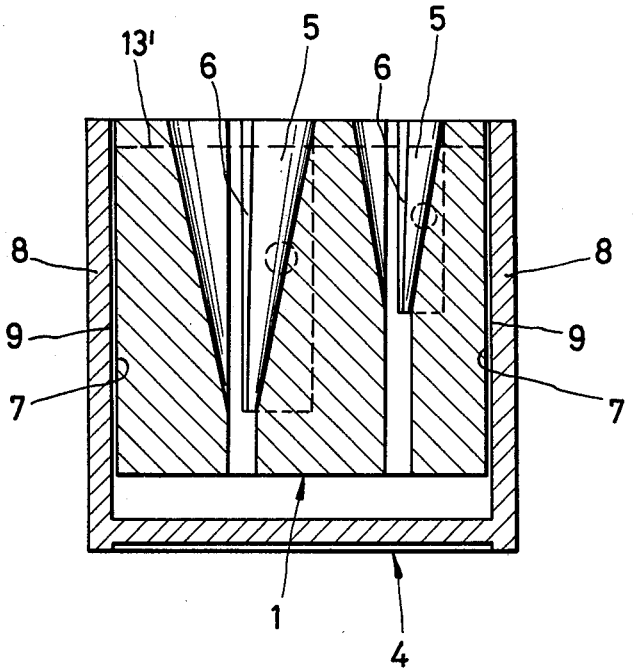
FIG. 3 shows a section along line C–D in FIG. 1, the cover/sharpener body unit having been pushed into the collector housing.

The pencil sharpener according to the invention consists in principle of the unit, marked 1 in total, of the sharpener body 2 and the cover 3, which are integral with one another, and of the collector housing, marked 4 in total. In the present illustrative embodiment, the unit 1 has been cut from an extruded profile, the cross-section of which is shown in FIG. 2. The sharpener holes 5 serve for the introduction of pencils, crayons, cosmetic sticks and the like, which require sharpening. The sharpener blades are marked 6.

The unit 1 is delimited, on two mutually opposite sides, by two continuous outer surfaces 7. The collector housing 4 possesses two continuous inner surfaces 9 on two mutually opposite guide walls 8. The dimensions of the sharpener component are such that the unit 1 can be pushed slidingly, by its outer surfaces 7, into the collector housing 4, that is to say into the inner surfaces 9 thereof. According to this illustrative embodiment, the surfaces 9 and 7 are parallel to one another. This achieves the manufacturing advantages described and permits the unit 1 to be easily pushed into, and drawn out of, the collector housing.

The catch or snap-fit connection already mentioned can be formed by projections and recesses, or undercuts, which are of such shape that when the unit 1 is pushed into the collector housing the projections engage in the recesses, or behind the undercuts, and disengage again as the unit is drawn out. For this purpose, it is advisable to provide appropriate chamfered surfaces and to ensure that the parts to be joined have a certain resilience. In the present illustrative embodiment, the cover 3 is provided on both sides with projecting portions 10, on which there are, as shown in FIG. 2, extensions 11 which point downwards, that is to say point towards the collector housing, and which are each provided with an undercut formed by a chamfered surface 12. The collector housing 4 possesses support walls 13, against whole end-face edges, 13', the projecting parts 10 of the unit 1 rest, in the use position. In the end zone, which in FIG. 2 is at the top, of the support walls 13, projections 14 are provided in the outer sides of the walls, and these projections, in the engagement position, are engaged in the undercuts formed by the surfaces 12.

FIG. 2 shows that the support walls are shorter, by an amount equal to the thickness b of the cover, than the guide walls 8, so that in the use position the surface 15 of the cover is flush with the upper edge 16 of the guide walls (see also FIG. 1). Further, it can be seen that the projecting parts 10 of the cover, and in particular their extensions 11, protrude outwards beyond the support walls 13 and therefore serve as a means of handling when the unit 1 is pushed into, and drawn out of, the collector housing 4. The extensions 11 can also be gripped from below. The guide walls 8 can project, with their longitudinal side edges 8', to the point that in the use position these edges are flush with the outer edges 11' of the extensions 11.

While only a single embodiment of the invention has been described in detail, it will be appreciated that the invention is not limited to the specifics thereof and numerous modifications are possible within the scope of the appended claims.

What is claimed is:

1. A pencil sharpener having a collector housing and an integral cover/sharpener unit releasably attachable to the collector housing with the sharpener extending into the collector housing, the collector housing having side walls comprising the cover/sharpener-unit being defined on two opposite sides by two continuous outer guiding surfaces;

the collector housing having two inner guiding surfaces on two opposite facing walls, the dimensions of the sharpener elements being selected so that said outer guiding surfaces are parallel to and slidingly engage said inner guiding surfaces to guide said cover/sharpener-unit during its insertion into and removal from said housing;

said cover at the sides of the sharpener other than the sides having said outer guiding surfaces is provided with portions which laterally project over the side walls of said housing having said inner guiding surfaces, said side walls serving as support walls for said laterally projecting portions; and the cover/sharpener-unit being releasably attachable to the collector housing by a snap means which comprises cooperating engageable protrusions and recesses integral with said support walls and said laterally extending portions.

2. The pencil sharpener according to claim 1, wherein said support walls are shorter than said guide walls by the thickness of the cover.

3. A pencil sharpener having a collector housing and an integral cover/sharpener-unit releasably attachable to the collector housing with the sharpener extending into the collector housing, the collector housing having side walls comprising the cover/sharpener-unit being defined on two opposite sides by two continuous outer guiding surfaces;

the collector housing having two inner guiding surfaces on two opposite facing walls, the dimensions of the sharpener elements being selected so that said outer guiding surfaces are parallel to and slidably engage said inner guiding surfaces to guide said cover/sharpener-unit during its insertion into and removal from said housing;

said cover at the sides of the sharpener other than the sides having said outer guiding surfaces is provided with portions which laterally project over the side walls of said housing having said inner guiding surfaces, said side walls serving as support walls for said laterally projecting portions;

the cover/sharpener-unit being releasably attachable to the collector housing by a snap means which comprises cooperating engageable protrusions and recesses integral with said support walls and said laterally extending portions; and said support walls being shorter than said guide walls by the thickness of said cover and said snap means comprising protrusions on the outer surfaces of said support walls and extensions on said laterally projecting cover portions, said extensions being undercut to form said recesses so that by pushing said cover onto the collector housing, said protrusions fit into said undercuts and by pulling said cover from the collector housing, the protrusions will disengage from said undercuts.

4. The pencil sharpener according to claim 3, wherein said undercuts comprise chamfered surfaces and the parts which are snap-fitted together have a certain elasticity.

* * * * *